US009273690B2

(12) United States Patent
Flenche

(10) Patent No.: US 9,273,690 B2
(45) Date of Patent: Mar. 1, 2016

(54) FLUID COMPRESSOR AND/OR PUMP ARRANGEMENT

(75) Inventor: George Flenche, Elizabeth Downs (AU)

(73) Assignee: Exodus R&D International PTE LTD, Salisbury (AU)

( * ) Notice: Subject to any disclaimer, the term of this patent is extended or adjusted under 35 U.S.C. 154(b) by 696 days.

(21) Appl. No.: 13/509,584

(22) PCT Filed: Nov. 12, 2010

(86) PCT No.: PCT/AU2010/001518

§ 371 (c)(1),
(2), (4) Date: Sep. 25, 2012

(87) PCT Pub. No.: WO2011/057348

PCT Pub. Date: May 19, 2011

(65) Prior Publication Data

US 2013/0011289 A1 Jan. 10, 2013

(30) Foreign Application Priority Data

Nov. 12, 2009 (AU) ..... 2009905514

(51) Int. Cl.

| | |
|---|---|
| ***F04C 9/00*** | (2006.01) |
| ***F04C 15/06*** | (2006.01) |
| ***F04C 14/14*** | (2006.01) |
| *F01C 17/02* | (2006.01) |

(52) U.S. Cl.

CPC ..... *F04C 15/06* (2013.01); *F04C 9/002* (2013.01); *F04C 14/14* (2013.01); *F01C 17/02* (2013.01); *F04C 2250/10* (2013.01)

(58) Field of Classification Search

CPC ..... F04C 9/002

USPC ..... 417/481, 482, 410.3; 92/122

See application file for complete search history.

(56) References Cited

U.S. PATENT DOCUMENTS

| | | | | |
|---|---|---|---|---|
| 1,010,583 | A | 12/1911 | Carmichael et al. | |
| 1,516,584 | A * | 11/1924 | Wilson | 417/482 |
| 2,359,819 | A * | 10/1944 | Bachrach | 417/481 |
| 2,413,636 | A * | 12/1946 | Long | 92/122 |
| 2,433,461 | A * | 12/1947 | Kuttner | 92/122 |
| 4,125,058 | A | 11/1978 | Forster | |
| 4,252,509 | A * | 2/1981 | Hagerty | 417/482 |
| 4,819,440 | A | 4/1989 | Nakajima et al. | |
| 5,979,163 | A * | 11/1999 | Hanners et al. | 60/571 |
| 6,453,688 | B1 | 9/2002 | Ijiri | |

FOREIGN PATENT DOCUMENTS

| | | |
|---|---|---|
| BE | 347490 | 1/1928 |
| DE | 2613472 | 10/1977 |

(Continued)

OTHER PUBLICATIONS

Patent Cooperation Treaty; International Search Report of PCT/AU2010/001518; Dec. 22, 2010; Ian Hill; 2 pages.

*Primary Examiner* — Nathan J Newhouse
*Assistant Examiner* — Christopher Bobish
(74) *Attorney, Agent, or Firm* — Weiner & Burt, P.C.; Irving M. Weiner; Pamela S. Burt

(57) ABSTRACT

The present invention relates to a compressor or pump unit for the production or flow of compressed fluid and more particularly to a new uniquely designed compressor which has the capabilities to both draw fluid from an intake opening and direct dischargeable compressed fluid to a storage tank utilizing a single compressor chamber simultaneously.

26 Claims, 11 Drawing Sheets

(56) References Cited

FOREIGN PATENT DOCUMENTS

| | | |
|---|---|---|
| EP | 0261507 | 3/1988 |
| EP | 0374798 | 4/1995 |
| EP | 1034951 | 9/2000 |
| GB | 2233713 | 1/1991 |
| KR | 100762892 B1 | 10/2007 |
| WO | 89/05918 A | 6/1989 |

* cited by examiner

FLUID COMPRESSOR AND/OR PUMP ARRANGEMENT

CROSS-REFERENCE TO RELATED APPLICATIONS

This application is a U.S. National Phase application submitted under 35 U.S.C. §371 of Patent Cooperation Treaty application serial no. PCT/AU2010/001518, filed Nov. 12, 2010, and entitled IMPROVED FLUID COMPRESSOR AND/OR PUMP ARRANGEMENT, which application claims priority to Australian patent application serial no. 2009905514, filed Nov. 12, 2009, and entitled IMPROVED FLUID COMPRESSOR AND/OR PUMP ARRANGEMENT.

Patent Cooperation Treaty application serial no. PCT/AU2010/001518, published as WO 2011/057348, and Australian patent application serial no. 2009905514, are incorporated herein by reference.

TECHNICAL FIELD

This invention relates to a compressor or pump unit for the production or flow of compressed fluid and more particularly to a new uniquely designed compressor which has the capabilities to both draw fluid from an intake opening and direct dischargeable compressed fluid to a storage tank utilizing a single compressor chamber simultaneously.

BACKGROUND

From hereonafter throughout this specification the use of the word compressing is to be considered synonymous with the ability to also pump therefore while the apparatus described throughout this invention may relate to the compressing of a fluid, it is to be appreciated by the person skilled in the art that the apparatus defined is equally capable of pumping fluid.

It is customary at present to provide compressors in two basic types, those associated with positive displacement "intermittent flow" and those adapted to provide "dynamic" or "continuous flow".

For the most part the positive displacement type compressors utilize what could best be described as a squeezing confinement effect to force fluid from a larger enclosed volume towards a much smaller chambered outlet.

On the other hand the dynamic compressor type arrangements utilize mechanical action so as to force admitted fluid drawn into the system to increase its velocity which is then converted into pressure.

The positive displacement compressor for the most part are of a rotary volumetric type, typically with radial vanes, driven by an electric motor. These compressors draw fluid from the atmosphere through an intake opening and directed to a pressure tank through a minimum pressure valve which opens only when a predetermined minimum pressure has been reached within a compressor unit.

Alternatively the dynamic compressors are conventionally arranged so that power which is also for the most part derived from a driving motor is transmitted to a crankshaft through pulleys and/or belts to rotate the crankshaft so as to reciprocate a piston which is received in a cylinder provided at the upper side of the crank case which defines a main body of the compressor, thus causing the outside fluid to be sucked into the cylinder from a suction pod through a filter, wherein compressed fluid is then delivered from a delivery port to a compressed fluid storage tank.

Both these arrangements have significant disadvantages not the least that for the rotary constructed compressor with the intermittent operation type control system means that the operations electric motor is suspended when the pressure reaches the upper limit value, while this may reduce electric power loss, nonetheless since the motor is started over again from the stationary state when the pressure falls thereafter, it is impossible to promptly supply compressed fluid when required.

Alternatively the continuous operation as discussed above also has its downfalls since the electric motor is continuously run even when the unloader is in an operative state, electric power loss is unavoidable, which not only adds extra cost to running the compressor unit but also importantly such arrangements make it unsuitable for conditions in which the rate of consumption of the compressed fluid is relatively high.

Therefore there clearly remains a need in the relevant art of compressor fluid units to come up with a new form of technology that can address these problems and others associated with conventional assemblies that are either definable or interpretable as intermittent or continuous flow characterization.

Accordingly embodiments of this invention provide a new compressor unit that provides a configuration which is substantially different in design than hitherto provided for compressor unit assemblies but also one that is able to provide a means in which both fluid can be admitted and discharged to and from a single compression chamber during a single cycle.

Further objects and advantages of this invention will become apparent from a complete reading of the specification.

SUMMARY

Accordingly in one form of the invention although this need not be the only nor indeed the broadest form of the invention there is provided a compressor unit for the production of compressible fluid, said unit characterized by:

a compression portion including a compression chamber having a plurality of radial compartments defined by baffles;

a means of rotating said baffles to a back and forth oscillating motion;

an inlet chamber for admitting fluid to be compressed there into said compression chamber;

an outlet chamber for discharging compressed fluid from said compression chamber;

fixed solid segments radially disposed inside said compression chamber such that each radial compartment includes a solid segment therein, each solid segment having walls extending towards the centre of the chamber and dimensioned such that during individual cycles fluid is drawn into one side of the compartment when a baffle moves away from said solid segment, and fluid is compressed and discharged from the other side of the compartment when an adjacent baffle moves towards said solid segment;

a valve means including a first chamber in fluid communication with one side of said radial compartment, and a second chamber in fluid communication the other side of said radial compartment, whereby fluid inside said first and second chambers is fluid that is either drawn into the compartment from the inlet means or is compressed fluid discharged out of the compartment by force of the baffles; and wherein said first and second chambers are in fluid communication with said inlet and outlet chambers such that in anyone cycle the chamber which is receiving compressed fluid is in fluid communication with the outlet chamber and the chamber from which fluid is being drawn is in fluid communication with the inlet chamber.

Preferably said compressor unit further includes a drive portion supporting a rotatably drivable shaft in operable communication with the compression portion.

In preference said drive portion is an electric motor.

The compressor unit further includes a cam means adapted to translate rotable motion of the drivable shaft into a back and forth oscillation movement of a shaft from which said baffles extend radially outwardly.

The valve means includes a valve plate wherein said first and second chambers are in the form of inner and outer concentric rings, and a valve disc between the valve plate and baffles said valve disc including apertures which allow for fluid communication between the radial compartments and the concentric rings.

In preference said inlet chamber is characterized by including an open ended conduit, circumferentially positioned about one side of the outer concentric ring, wherein the respective ends of said open ended conduit connect by a separate hollow channel to one of the concentric rings.

The outlet chamber is characterized by including an open ended conduit, extending about the outer concentric ring on an opposing side to said inlet open ended conduit, wherein the respective open ends of said conduit connect by a separate hollow channel of one of the concentric rings.

In preference said valve means includes a rocker control valve in oscillating operable communication with the cam means so that just a single end to each of the open ended conduits of the respective inlet and outlet means are open during a particular cycle or back/fourth oscillation.

A compressor unit as characterized herein, wherein said baffle shaft includes six radially disposed baffles defining six radial compartments.

In a further form of the invention there is proposed a compressor unit for the production of compressible fluid, said unit including:

a main housing block;

said main housing block providing a drive portion supporting a rotatably drivable shaft in operable communication with a compression portion of said main housing block;

the compression portion defining a compressor chamber in its interior;

inlet means communicating with said drivable shaft and the compressor chamber of the main housing block for admitting fluid to be compressed there into said compressor chamber of the compression portion of the main housing block;

outlet means communicating with said compression chamber for discharging compressed fluid therefrom said compression chamber of the compressor portion of the main housing block to a compressed fluid storage tank;

two substantially circular rings or slots supported within a single plate or platform wherein said substantially circular rings are concentric one about the other, said circular rings defining hollow passage ways through the said plate or platform appearing along the lengths of these hollow passages are a series of apertures so that fluid may enter the concentric rings pass along through the hollow passages and out through the apertures along the lengths of the concentric rings to either enter or exit said compression chamber;

said inlet means including an open ended conduit, circumferentially positioned about one side of the outer substantially concentric rings, wherein the respective ends of said open ended conduit connect by a separate hollow' channel to one of the concentric rings;

said outlet means including an open ended conduit, extending about the outer concentric ring contained in the single platform or plate on an opposing side to said inlet open ended conduit wherein the respective open ends of said conduit connect with a separate hollow channel of one of the concentric rings;

flow control valves so that the admitted and/or discharged fluid/compressed fluid to and from the hollow passages of the concentric circular rings may be controlled by said flow control valves;

the compressor chamber further defining a compressor means of compressing the admitted fluid, including rotably supporting crisscrossing battles and intermittent triangular segments adapted to move relative one with or to the other;

said triangular segment including, orifices or elongated recesses at least partially extending into the depth of said triangular segment, wherein each orifice or recess is located on an opposing side edge of triangular segment so as to simultaneously absorb and/or discharge fluid to a corresponding concentric ring;

a cam mechanism adapted to translate the rotable motion of the drivable shaft. into a back and forth oscillation movement of said crisscrossing baffles against the triangular section for fluid to be admitted through the recess or orifice or to be discharged from the opposing orifice or recess during individual cycles.

In preference the flow control valves are in oscillating operable communication with the cam mechanism so that just a single end to each of the open ended conduits of the respective inlet and outlet means are open during a particular cycle or back/fourth oscillation.

Advantageously, this arrangement provides for a mechanism in which fluid can be admitted and then discharged continuously from the one single compressor chamber.

Through the unique use of the two concentric rings, along with the novel inlet and outlet slots and the control valves oscillating between the respective ends to open and close each of the inlet and outlets for each cycle means that the interaction between the triangular sections and the baffles has a bellowing wherein fluid can be sucked in from one of the concentric rings while at the same time on the opposing side of the triangular segment as it moves to make close contact with the wall of the baffle fluid can be pressurized into a confined space and then discharged out as compressed fluid through the other concentric ring.

Basically, the crisscrossing baffles provide for divided segments wherein the dimensions of the triangular segments are slightly of less proportion which means that relative movement of the triangular section will fall within the divided confines of two baffles means that as the triangular segments moves away from one baffle towards the other baffle within the divide, means that on the side of the triangular segment to which spacing within the baffle divide is increasing it can absorb or suck out from the concentric ring fluid and then on the other side of the triangular segment where the confined space is now significantly less as this side of the triangular segment is pushed up against the side of the baffle, compressed fluid can be created and therefore discharged accordingly into the other concentric ring.

Nonetheless this is an important operation of the flow control valves which allows for each of the concentric rings to either be offering an opening to act as an inlet or discharge means between the compression chamber and the inlet/outlet.

Hence for each cycle, one of the concentric rings will be providing fluid to be compressed into the compressor chamber while the other concentric ring will be delivering compressed fluid to the discharge outlet into the fluid compressor storage tank.

By virtue of the cam mechanism the back and forth oscillating movement between the triangular segment and the baffles means that the respective concentric rings are alternating, again by virtue of the flow control valves, as offering a means in which fluid can be drawn into the divided sections or alternatively a means in which compressed fluid can be charged out through the relevant concentric ring into the compressed fluid storage tank.

In preference the baffles are supported on a ratable shaft, wherein the shaft by virtue of its structural arrangement with the cam mechanism will oscillate or swing back and forth over a defined degree of angle.

In preference there are six individual radially extending baffles from the main rotable support shaft in the compression chamber providing six divided partitions.

In each of these partitions is the corresponding triangular segment.

Preferably it is the triangular segment that is fixed around the outer frame. Much like the stator frame in a motor wherein the triangular segment would he fixed and extend inwardly towards the rotor which in this case is in fact the haftles which are supported on the shaft to which rather than complete circular motion oscillates back: and forth over a restricted defined degree of oscillation.

As introduced above, preferably the inlet and outlet conduits would in fact also be slots or passageways circumferentially encompassing opposing sides within the plate or platform around the outermost concentric ring.

In preference the orifices or recesses would extend into the depth of the triangular segment on opposing edges of the triangular segment and are substantially conical or cone type in configuration with part of the edge, length or shoulder of the conical configuration opened up so as to again provide a design where fluid passage flow is always moving from to a space of varying bounded dimension.

In preference the degree of rotation of the back and forth oscillated movement between the baffle and the triangular segment would be 20°.

BRIEF DESCRIPTION OF THE DRAWINGS

The above and other objects, features, and advantages of the present invention will be apparent from the following detailed description of a preferred embodiment in conjunction with the accompanying drawings. In the drawings.

DETAILED DESCRIPTION

The following detailed description of the invention refers to the accompanying drawings.

Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

Figure 1:
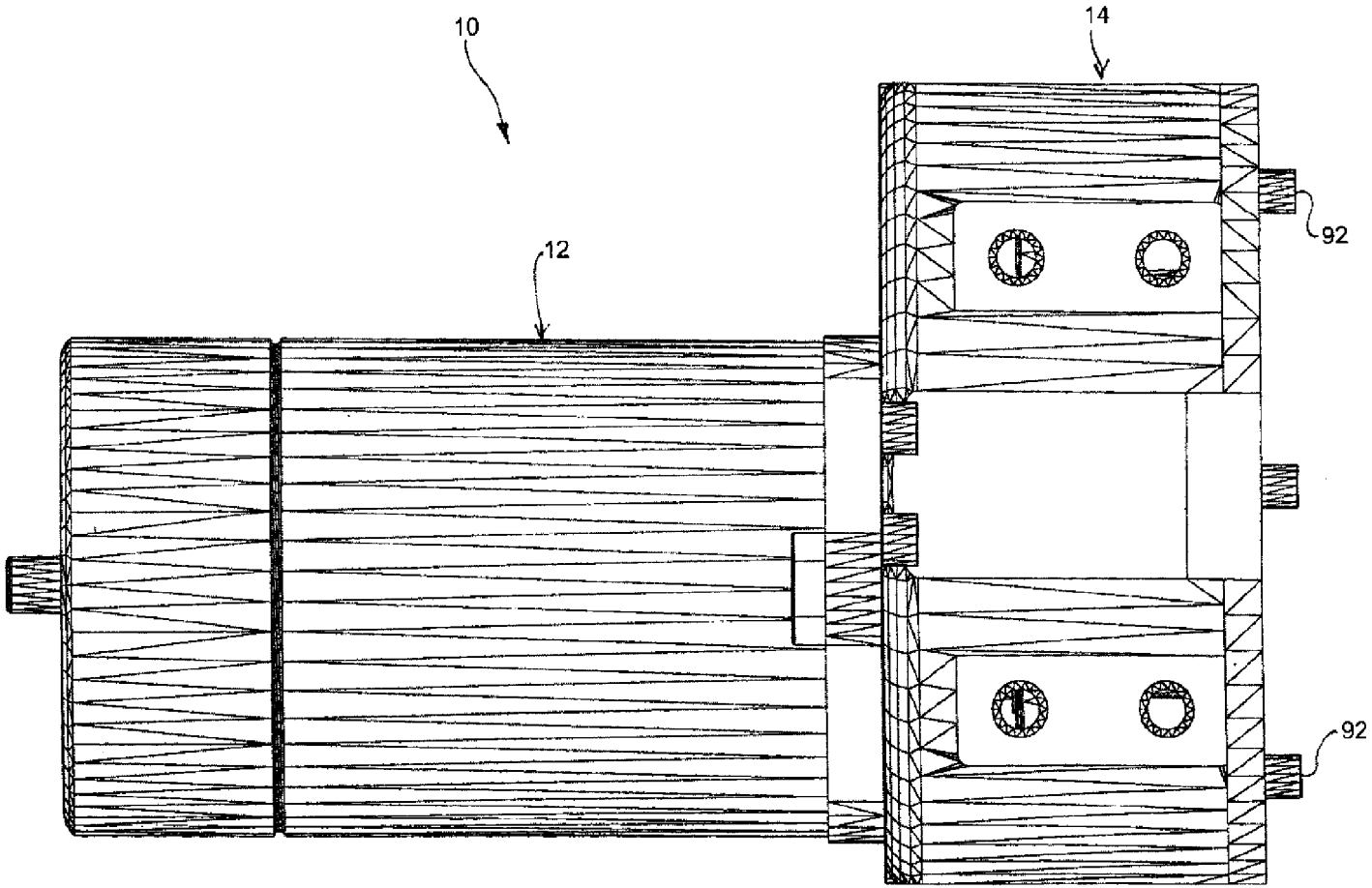
FIG. 1 is a side view showing an assembled fluid compressor unit including a drive portion and a compression portion in accordance with the present invention.
Figure 2:
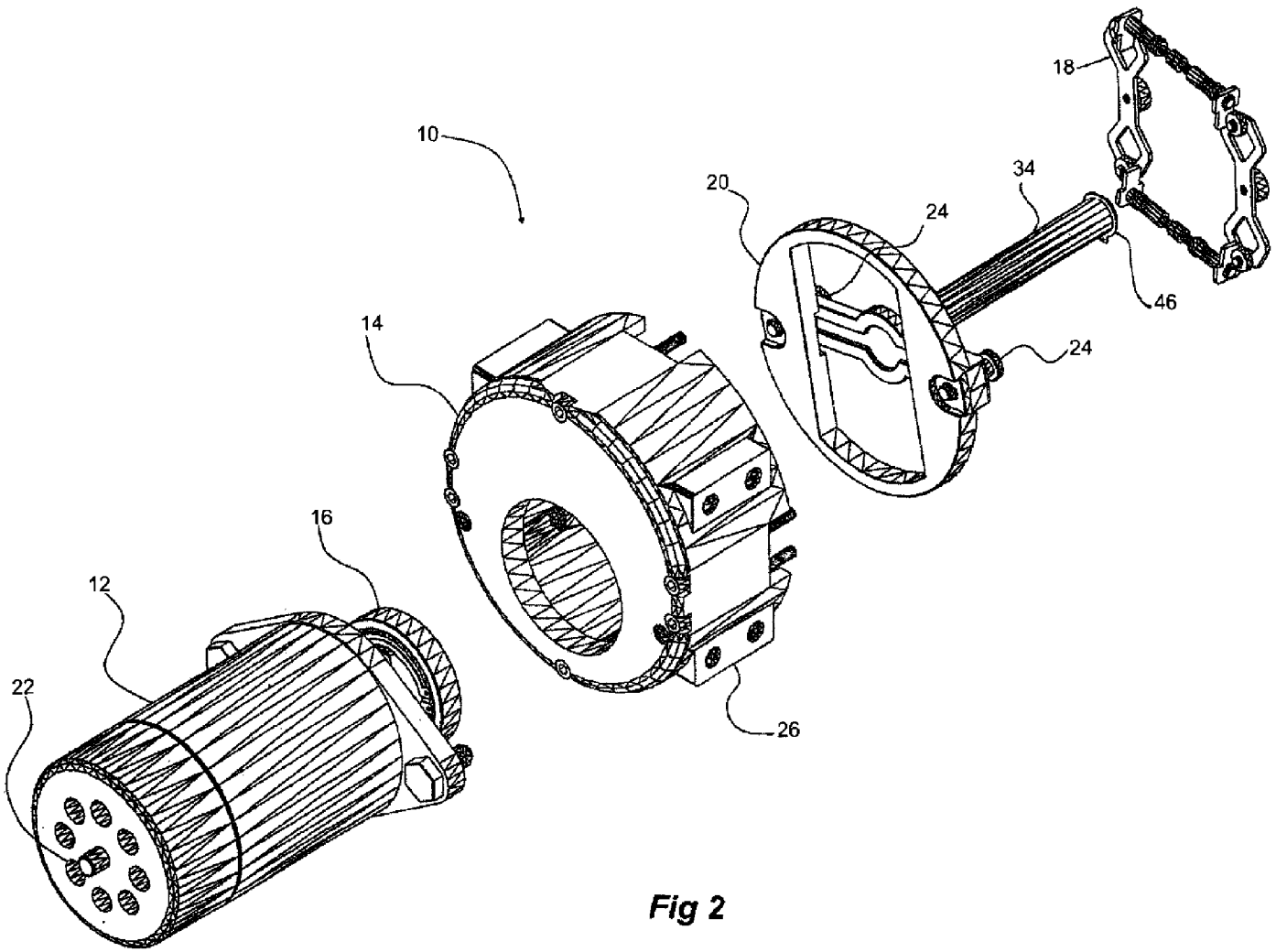
FIG. 2 is a perspective exploded view showing the main housing block including the drive portion as well as some parts of the compression portion enclosed section.

FIG. 1 illustrates components of an assembled compressor unit, and provided in FIG. 2 is a perspective view looking at the exploded external configuration of the main housing block of the compressor unit.

As can be seen, the compressor unit shown generally as 10 includes a drive portion 12, which in this embodiment is an electric motor, and a compression portion 14. Some of the internal components of the compression portion are hidden in FIG. 2, which will become apparent.

In this embodiment this compressor unit utilizes an electric motor as the main formal means in which to drive the shaft to provide a rotary motion which is utilized by the compression portion of the main housing block of the compressor unit to be discussed hereafter. Nonetheless the driving of the shaft which will rotate the eccentric cam 16 and inter engage with a rocker control or arm 18 and the cam ring 20, can be done so through a variety of means.

In the embodiment shown, the electric motor and the rotor or input shaft 22 of the electric motor rotate an eccentric cam 16 which engages the rocker control 18 as well as the cam ring 20.

The degree in which the cam mechanism including the eccentric cam 16, rocker control 18, cam ring 16 and related pins 24 translate the rotatable motion of the electric motor shaft to the back and forth oscillation movement of the baffles inside the compressor chamber to be discussed below can be controlled by pins 24.

Figure 3:
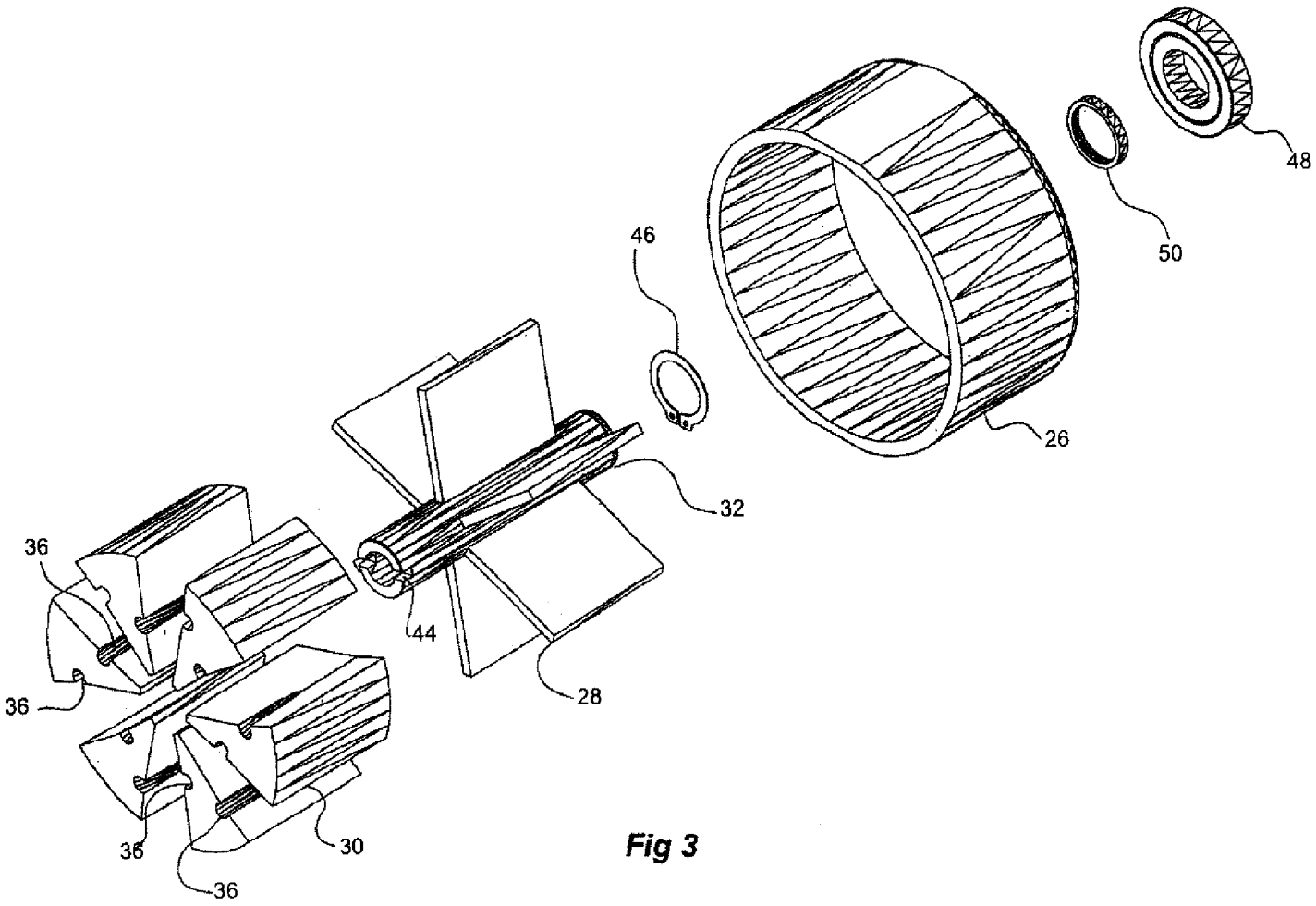
FIG. 3 is an exploded view showing the structural features making up the compression chamber.

As seen in FIG. 3 the compression portion of the main housing block includes an outer housing 26 which rotably supported therein is a star blade configuration of six radially extending out blades or baffles 28 which provide for dividable sections to which the triangular segments 30 are placed therein between. The blades 28 extend outwards from a shaft 32 which in the embodiment shown is internally configured such that it accommodates and engages with a control arm shaft 34, the shaft 32 hence being rotatable with the control arm shaft 34.

It is envisioned embodiment that the triangular segments will be supported, on a frame similar in concentric arrangement to the housing illustrated as number 26.

Each of the triangular segments includes a series of recesses or orifices shown at 36 on opposing sides along the side edges of the triangular segment 30. Each side wall of the triangular segments includes converging surfaces which meet approximately at the centre of each orifice 36.

The orifices or recesses 36, as illustrated in the illustration, are best configured as conical shapes that have been split in half. They are located at one end of the triangular segments adjacent a valve disc 38 which is described in more detail below with reference to FIG. 7*a*.

Figure 4:
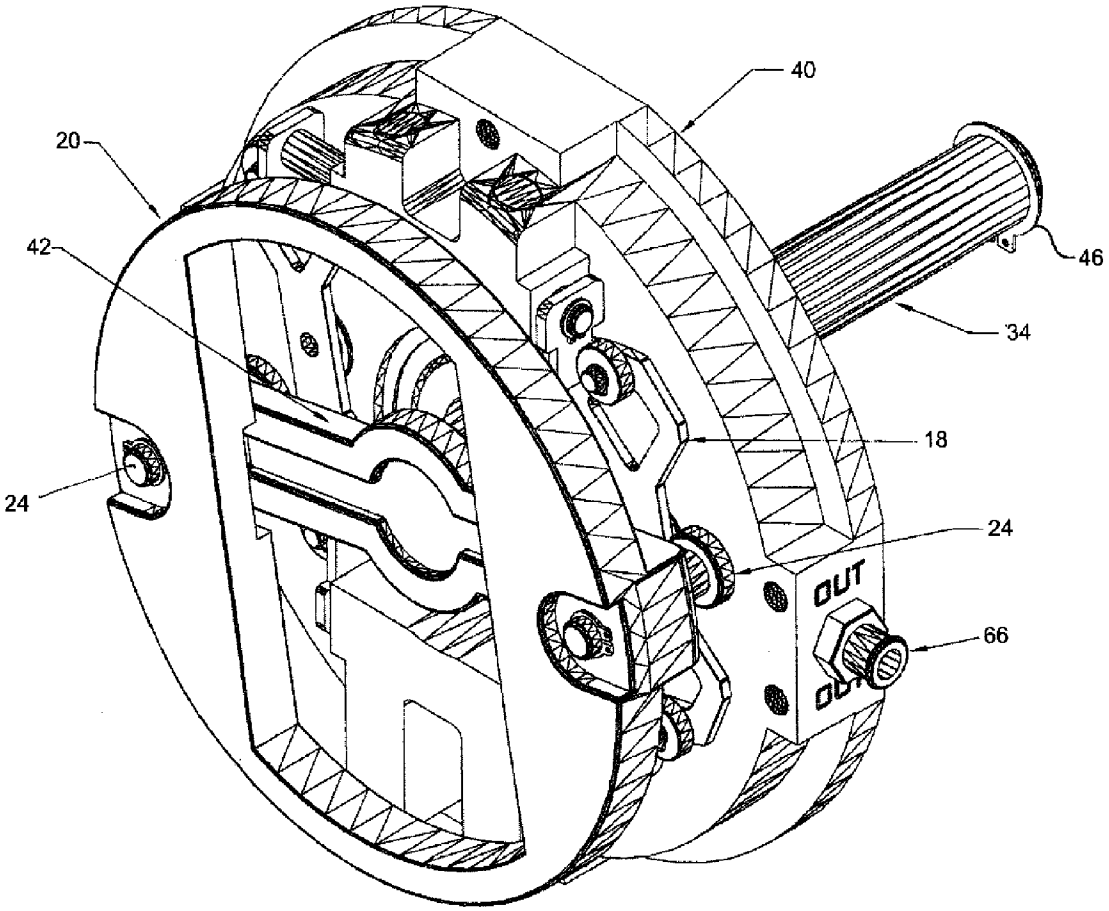
FIG. 4 is a perspective view of the cam ring, rocker arm, and valve plate in an assembled form.
Figure 5:
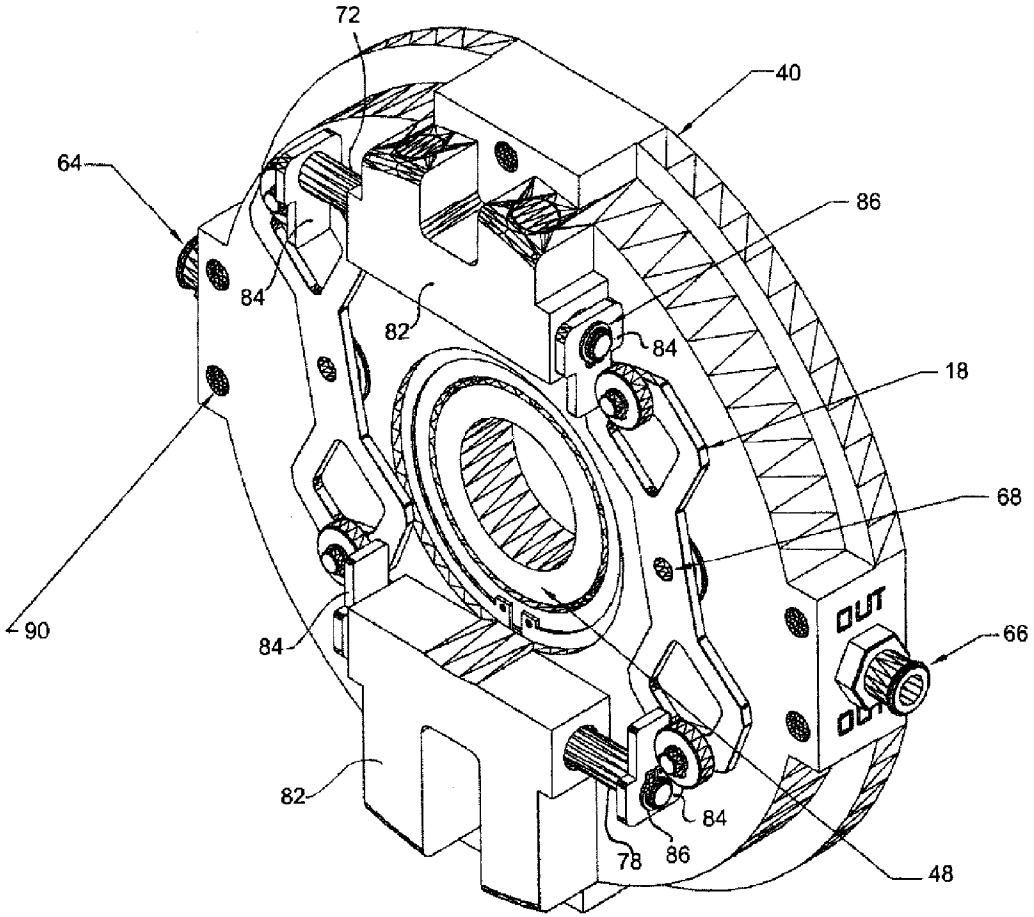
FIG. 5 is a perspective view of the rocker arm and front valve plate in an assembled form.
Figure 6:
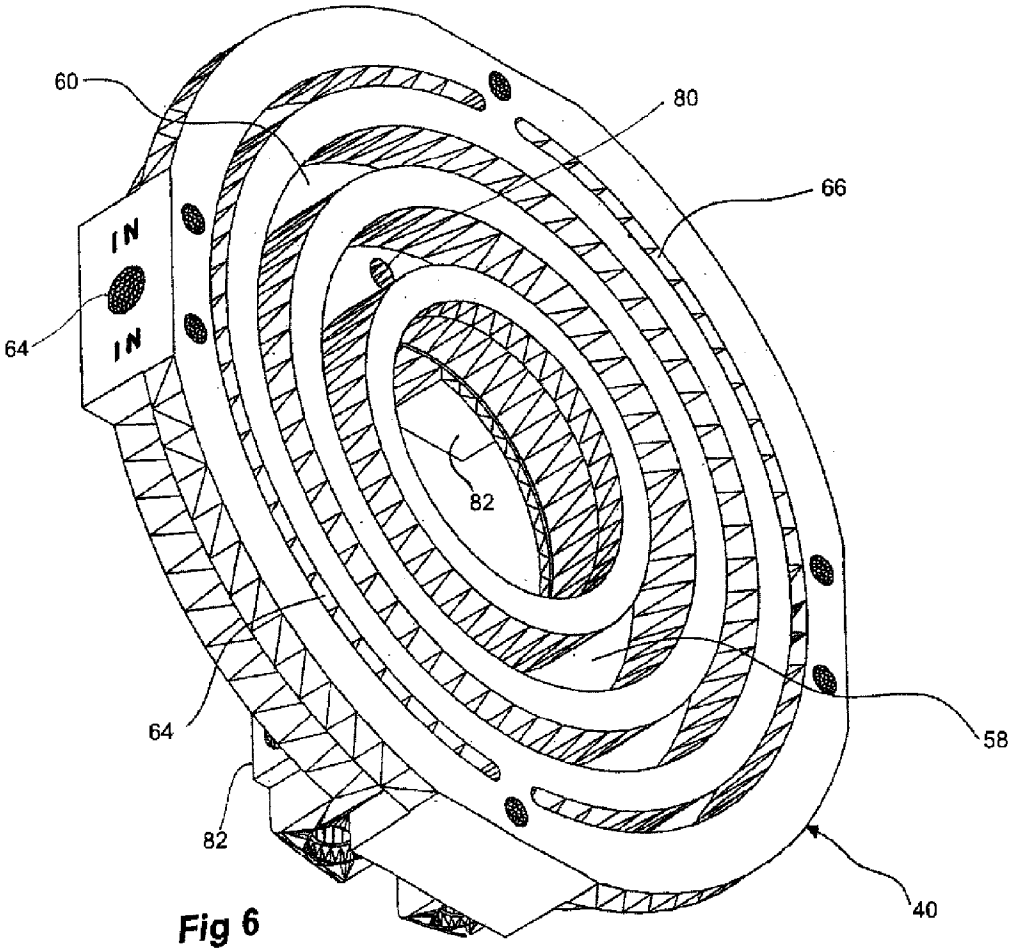
FIG. 6 shows a perspective view of the: valve plate, which provides or defines the various inlet, outlet and concentric ring slots to which the hollow passage therethrough of fluid allows for the admission and discharge of fluid to compressed fluid.

FIGS. 4 and 5 show how the cam ring 20, the rocker control 18, and a valve plate 40 are orientated inside the compression unit, and FIG. 6 shows the valve plate 40 on its own. In particular, the front surface of the valve plate 40 is shown which abuts with the valve disc 38, the various channels in the plate being described in more detail below. It should now thus be appreciated that the order in which the various components forming part of the compression portion align are the cam ring 20, then the rocker control 18, then the valve plate 40, then the valve disc 38, and then the triangular segments 30 and baffles 28 therebetween. The only parts which are connected in a manner which allows them to oscillate together are the earning 20 (which in turn causes the rocker control 18 to rock back and forth as described in more detail below), a control arm 42 associated with the cam ring 20, engaging shafts 32 and 34 and hence the blades 28.

Thus, the cam ring 20 is able to translate continuous rotational movement of a shaft 22 from a driving mechanism such as the motor and so forth into oscillated movements of the cam ring 20, and hence the control arm shaft 34 via the control arm 42 associated with the cam ring 20. The cam ring 42 oscillates back and forth when the eccentric cam 16 rotates via the input shaft 22. It is the eccentric path forth earn which causes the cam ring 20 to oscillate back and forth in this manner.

The skilled addressee would realize that there are a number of ways the rotational movement of shaft 22 could be translated into oscillated movement of the cam ring 20, etc, and the present invention is not intended to be limited to anyone means of achieving this.

The cam ring 20 is connected to the control arm 42 by locating pins 24 which also control the rocker arm/valve position as will be described. The control arm 42 is then connected to the shaft 32 supporting the blades by location lugs at 44, although other suitable connection means could be used. This connection ensures that when the cam ring 20 and control arm 42 oscillate back and forth, so does shaft 32 and associated blades 28. The shaft 32 is held in place by circlip 46 on the control arm shaft 34 which itself is supplied in the plate inside a main bearing 48. A seal 50 is also present to prevent leakage through the bearing.

Figure 7A:
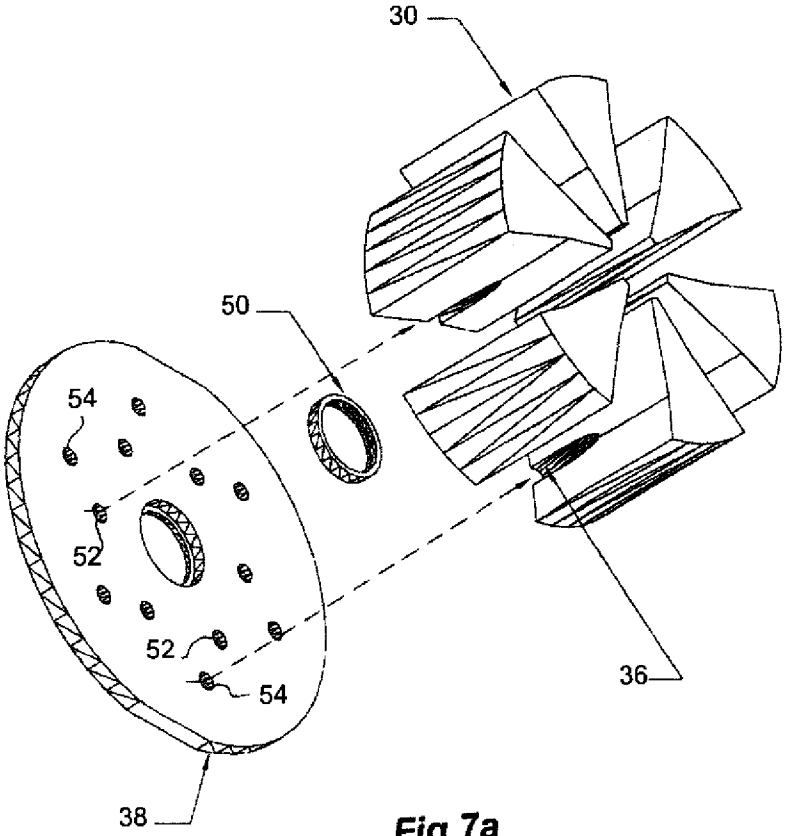
FIG. 7*a* shows an exploded perspective view of the triangular segments in the compression chamber and the valve disc which sits on the valve plate of FIG. 6 inside the compression chamber.
Figure 7B:
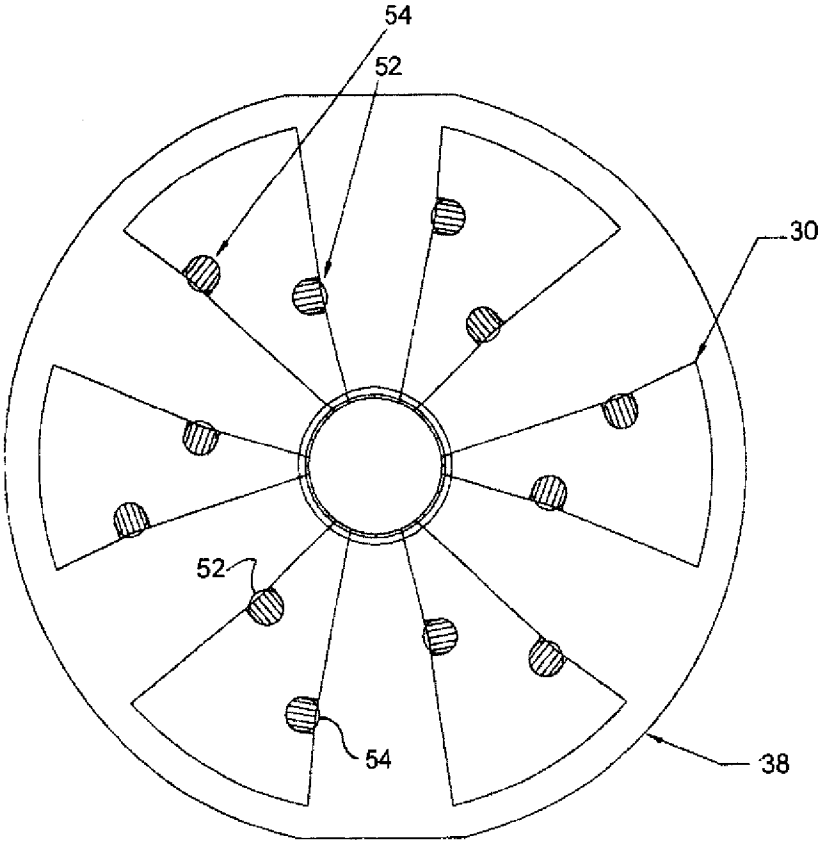
FIG. 7*b* shows the alignment of apertures through the components shown in FIG. 7*a;*

As shown most clearly in FIGS. 7*a* and 7*b*, the apparatus is constructed such that each orifice 36 present in the triangular segments 30 will rest over each of the inlet/outlet apertures 52 and 54 of each of the radial compartments that make up the compressor chamber and are defined or provided for by the baffles 28 that radially extend out from the shaft 32 which is adapted to oscillate hack and forth in relative movement against the positioned triangular segments 30.

Figure 8:
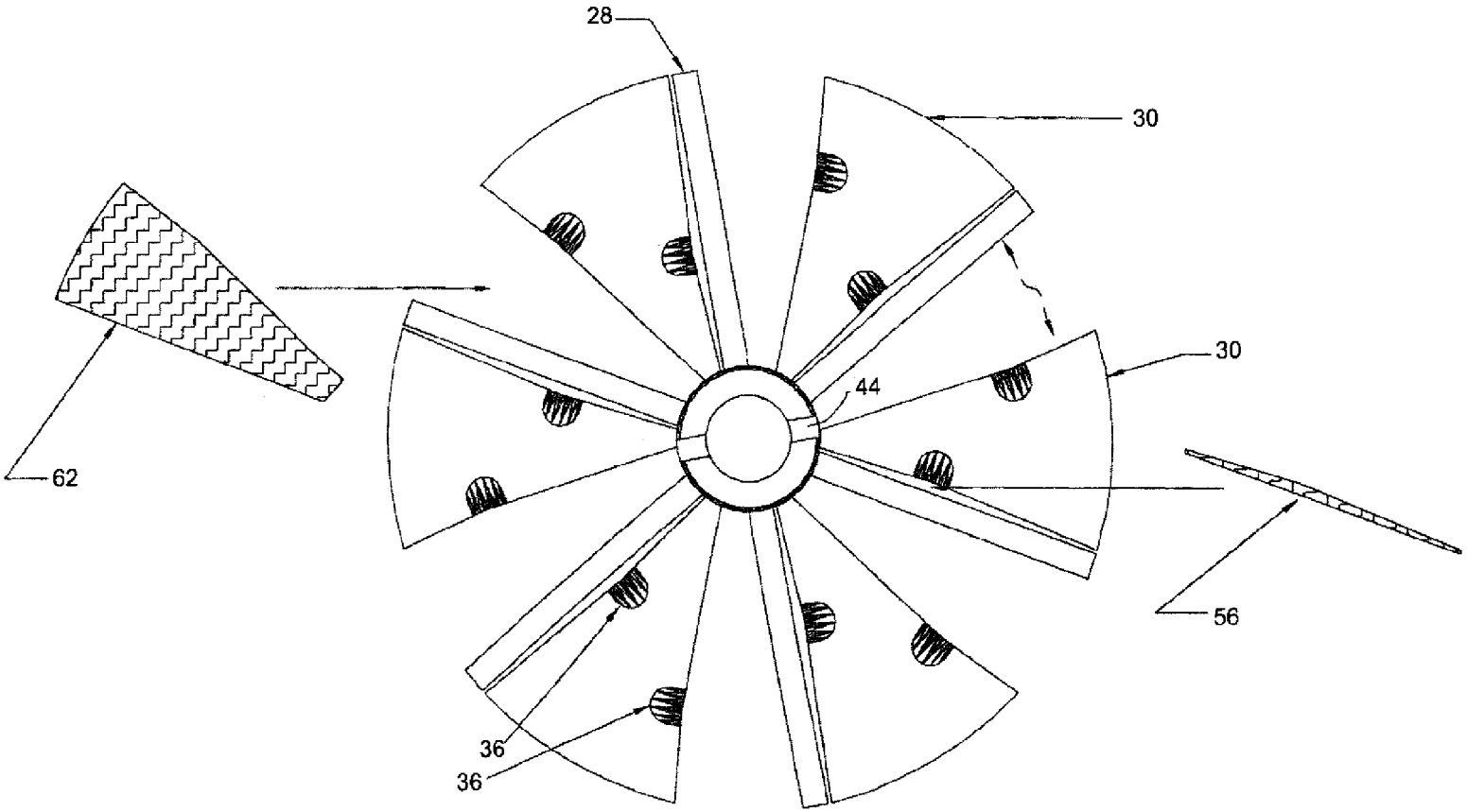
FIG. 8 shows an end view of the triangular segments and the blades or baffles present inside the compression chamber.

As perhaps best viewed in FIG. 8, with the triangular segments positioned in each of the dividers provided for by the six radially extended baffles, a rotation of a baffle towards the triangular segment 30 means that literally there is a bellowing effect whereby on the side on which space is being compacted there is space reduction zone 56 which in effect is compressing fluid and forcing it to be discharged through apertures 52, 54 into one of the concentric rings 58, 60 of the valve plate 40 to be discussed shortly hereafter, while on the opposing side of the triangular segment 30 within these divided baffle regions there is a space creation zone 62 which in effect is sucking or absorbing fluid into this open space from the other concentric ring which in a subsequent oscillation or swing back as the baffle oscillates from its two rotatable positions will then revert into the compression side.

Therefore as the person skilled in the art can appreciate each radial compartment defined inside the compressor chamber by virtue of the radially extending baffles 28, which in the preferred embodiment is six compartments, effectively has one inlet aperture and one outlet aperture.

In one embodiment, the angle of oscillation of each blade may be 20 degrees, the thickness of the triangular segments being constructed accordingly. However, it is to be understood that other configurations are possible, and that the thickness of the triangular segments may be determined by factors such as the application for which the pump/compressor is required, the compression ratio required, as well as the sealing requirements.

Turning back to FIG. 6, the configuration of the valve plate 40 is such that it includes an inlet chamber 64 and outlet chamber 66 which in this preferred embodiment are configured to be in substantial concentric arrangement with an enclosed inner concentric ring or conduit and an outer concentric ring or conduit, earlier described as concentric rings 58 and 60.

Figure 9A:
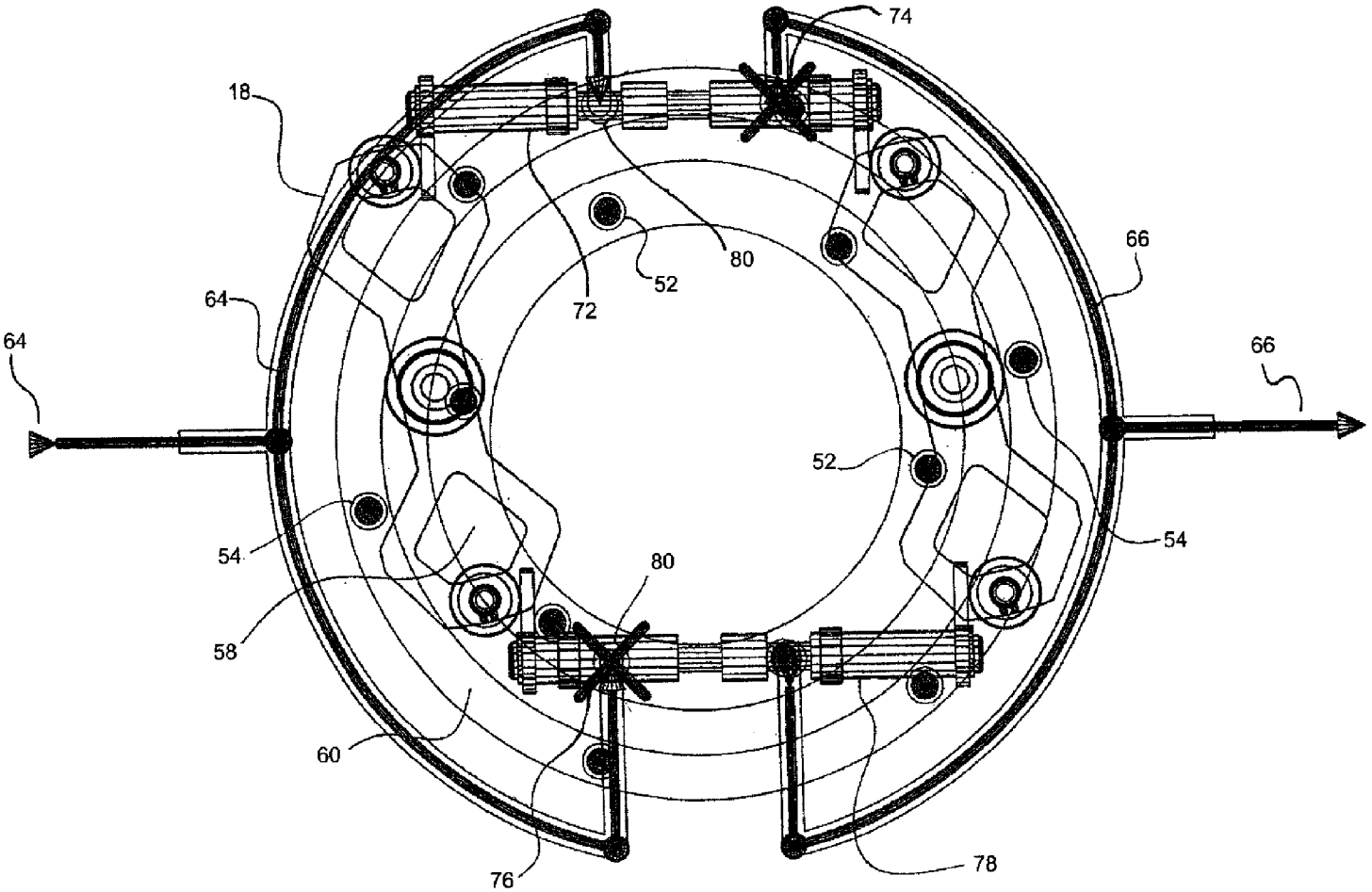
FIGS. 9*a* and 9*b* show schematically the operation of the flow control valves and the various interrelationships between the respective concentric inner and outer rings.
Figure 9B:
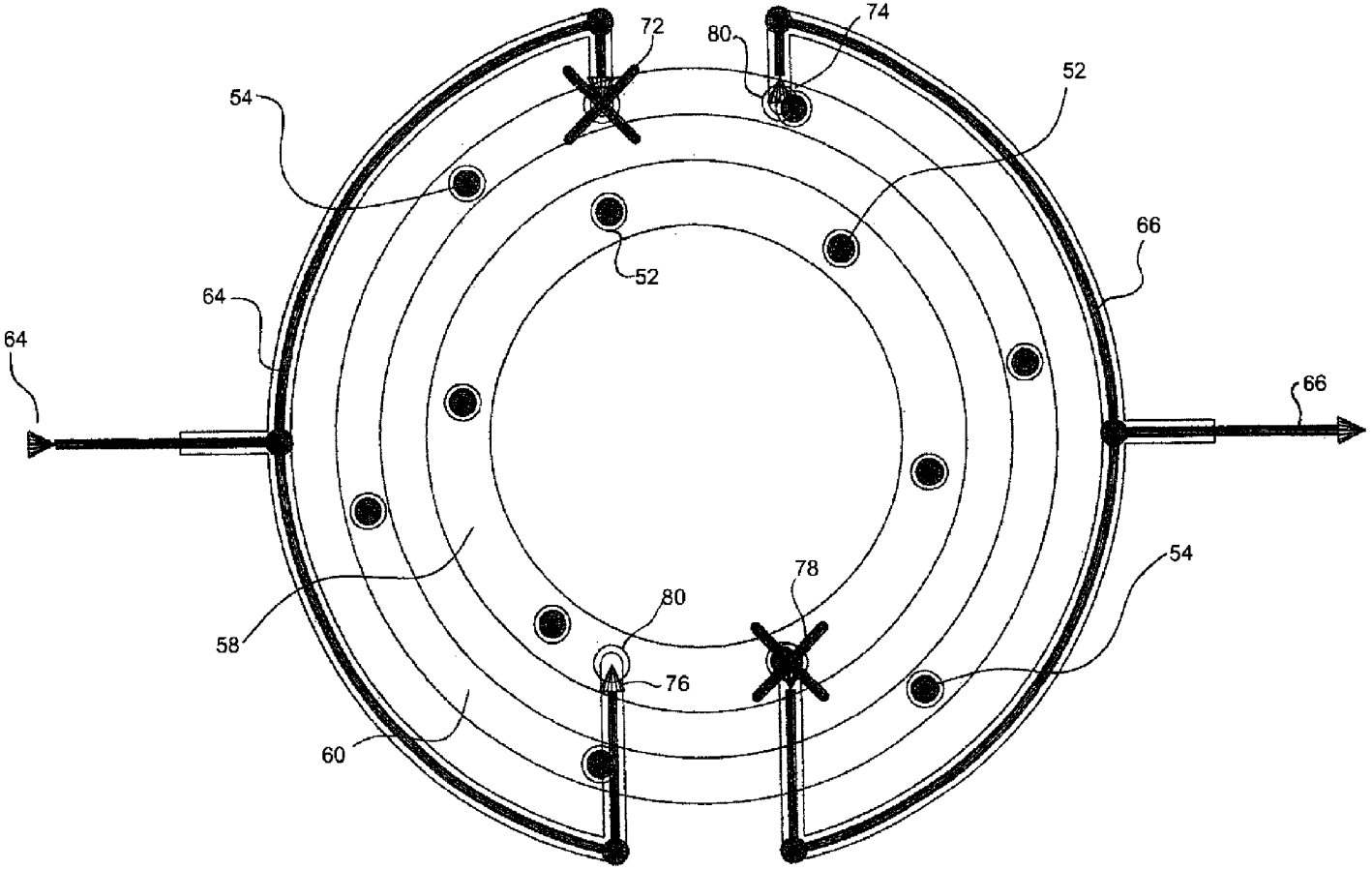

The outer concentric ring 60 is in fluid communication with the inlet chamber 64 when the rocker am) 18 is in a first position, as shown in FIG. 9*a*, and with the outlet chamber 66 when the rocker arm 18 is in a second position, as shown in FIG. 9*b*. Similarly, the inner concentric ring 58 is in fluid communication with the outlet chamber 66 when the rocker arm is in the first position, as shown in FIG. 9*a*, and with the inlet chamber 64 when the rocker arm is in the second position, as shown in FIG. 9*b*. The rocker arm 18 is rotatable about pivot points 68.

The rocker arm 18 includes four valves 72, 74, 76 and 78 in the front of cylindrical portions of varying cross sectional dimension along their length which control the flow of fluid to and from the inlet and outlet chambers as described above by moving over access apertures 80 extending into the respective concentric rings, FIG. 5 clearly shows the radially opposed parts of the valve plate which extend out from the plate to house the chambers connecting the inner and outer chambers with each of the inner and outer concentric rings. FIG. 6 shows one of those apertures 80 inside the inner concentric ring 58.

Thus, the concentric rings 58 and 60 are in operable communication with the rocker control 18. The pins 24 extending out from the control arm 42 oscillate together with the control arm 42, and by way of contact with the rocker arm 18 cause it to rock between the two positions. The four control valves 72, 74, 76 and 78 will rock or swing to and from in sequence with the baffle movement, thereby providing for at least one of the inlet openings in the disc 38 to be in a position to admit fluid into the compressor chamber or alternatively also provide for at least one of the outlet conduit openings the ability to discharge compressed fluid from the compressor chamber out into a compressed fluid storage tank (not shown).

The valve pairs 72 and 74, and 76 and 78, are moveable along single parallel axes inside each of the housing portions 82 and each valve pair is supported between two plates 84 associated with the rocker control 18 and disposed on either side of each housing portion 82. The valve portions are held in place using circlips 86. It can be appreciated in the drawings that one housing portion is longer than the other because one needs to connect the inlet and outlet chambers with the inner concentric ring, and the other needs to connect the inlet and outlet chambers with the outer concentric ring. In the embodiment shown, each of the housing portions includes parallel apertures 88 extending there through and the valves are cylindrical in shape of a cross section to be received in each aperture and hence prevent or allow access of fluid through an entry port, however, it is to be understood that other configurations are also possible. The reader is referred once again to FIGS. 9*a* and 9*b* to assist in their understanding.

This unique arrangement of utilizing the concentric rings 68 and 70, and the apertures 52 and 54 through the valve disc that align themselves when in position with the corresponding recesses and orifices of the triangular segments, provides a mechanism whereby this single compressor chamber can effectively be continuously within each cycle of a back and fro oscillation allow for fluid to be admitted into the pressure chamber and also compressed fluid to be discharged from the compressor chamber.

In more conventional arrangements for example, if using a reciprocated piston the only way in which a continuous supply of compressed fluid can be fed to the storage compressor tank would be to have a plurality of reciprocating pistons.

As is to be expected, the more pistons involved in the fluid compressor will increase the size and the power efficiency to operate a conventional fluid compressor to gel a particular return and level of supply of compressed fluid.

Figures 10A, 10B, 10C, 10D, 10E, 10F, 10G, 10H, 10I:
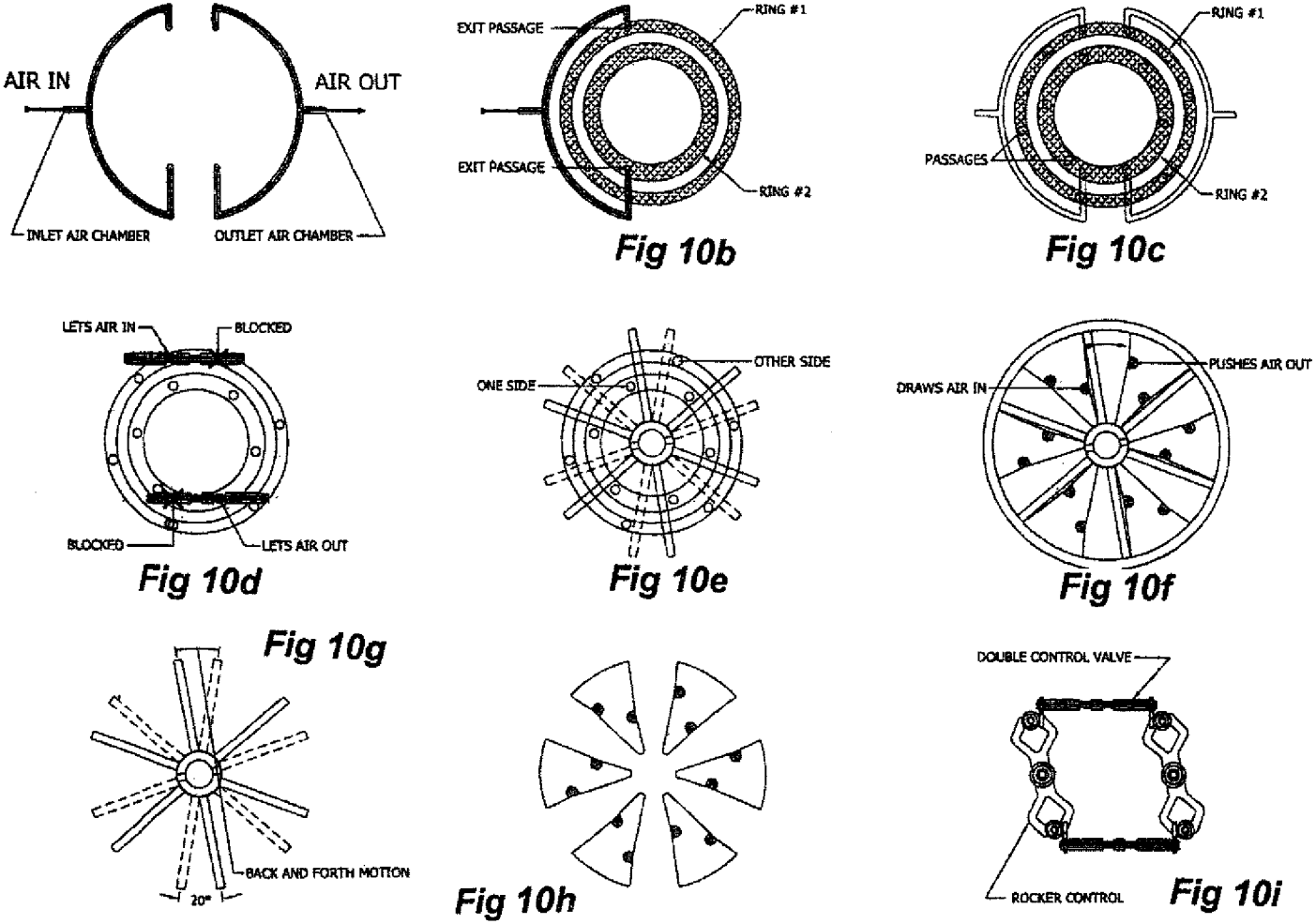
FIGS. 10*a* to 10*i* simply show basic schematics of some of the features that make up the compressor unit in its preferred embodiment.

FIGS. 10*a* through to 10*i* simply show schematically some of the components that make up the compressor unit and provide a useful visual overview of how the present invention works. FIG. 10*a* shows that there are two separate portions, that being the fluid intake passageway, slot or conduit designed to let filtered fluid into the pump and there another portion to release volume fluid out of the pump.

As can be seen in FIG. 10*b* the inlet chamber as two open ended extended passages one positionable in each of the respective first ring and second ring wherein the first and second ring are arranged concentric one about the other.

In FIG. 10*c* defined passage flows or holes of the first and second concentric rings allow separate exit passages on each of the ring chamber and six passages each into the star pump configuration, hence effectively the two ring chambers provide for twelve separate passages.

In FIG. 10*d* the two control valve pairs, one upper towards the first concentric ring blocking the exit passage to the second outlet ring with the lower control valve then designed to block fluid towards the second concentric ring whilst allowing fluid to exit to the fluid outlet.

FIG. 10*e* shows schematically how the first ring chamber has six passages corresponding to one side of the crisscross star plate configuration. The ring chamber of the second concentric ring also has six corresponding passages but on the opposite side.

As shown in FIG. 10*f* the star configuration provided for by the crisscross baffling has two sides on each of its six blades and as the rotation begins then one side of the blade is drawing fluid into the chamber while the other side of the blade is pushing fluid out of the chamber. This motion acts like a bellow expelling fluid in and expelling out fluid through the same fluid passages into one of the concentric ring arrangements, the opposite side or the blade is doing the opposite function to the other side. At one full rotation of input motor each blade has drawn in fluid and expel led the fluid once per blade, for example six in/out plus six out/in thereby providing twelve full volumes of fluid.

As seen in FIG. 10*g* the six crisscrossing blades oscillate on the axis of the rotating shaft in one direction then rotates in the opposite direction by the same amount of degrees.

An eccentric cam driven by an electric motor, as seen in FIG. 2, causes the swinging movement. The eccentric cam moves a cam ring which is connected to the rotatable shaft where the baffles radially extend out from. The cam ring also has two pins which control the two double upper and lower valves, controlling the timing and position of each valve opening and closing as described above.

FIG. 10*h* again reiterates the six partitions of the triangular segments that are designed to channel fluid towards entry/exit holes on each side of the partition face and can be totally redesigned to suit different applications and to allow space for foreign matter not to damage the blades and so forth.

FIG. 10*i* illustrates the two double valves (one upper and one lower) having a rocker control on each end of the valve assembly. As the input cam rotates and causes the ring cam to oscillate back and forth on its axis, the ring cam moves the double control valve in one direction and the rocker control moves the other valve assembly in the opposite direction at one full revolution of the input motor each double control valve has moved back and forth once.

While not expressly described above, the apparatus 10 is held together using a number of rods or bolts, with each component including appropriately positioned apertures to receive such fastening means. For example, whilst it is not shown in all drawings, there are apertures 90 which extend through the end of the housing 26, the fixed triangular segments 30, the valve disc 38, and the valve plate 40, to accommodate bolts 92. However, it is to be understood that alternately configured fasting means could equally well be used.

Further advantages and improvements may very well be made to the present invention without deviating from its scope. Although the invention has been shown and described in what is conceived to he the most practical embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e., the features specified may be associated with further features in various embodiments of the invention.

The invention claimed is:

1. A compressor or pump unit apparatus including:

a compressor chamber and a plurality of radial compartments, wherein adjacent baffles of a plurality of intermittent, radially disposed baffles which extend from a central shaft of the chamber outwardly towards an inner edge of the chamber define a boundary for each radial compartment, whereby disposed in each said radial compartment is a fixed solid segment having a triangular structure extending between the central shaft and the inner edge of the chamber, with respect to which the baffles are adapted to move to compress admitted fluid, said apparatus further including a means of rotating said central shaft and hence said baffles in a back and forth rotation oscillating motion, said apparatus characterised by:

a first chamber associated with a valve plate assembly disposed at one end of said compressor chamber, for admitting fluid to be compressed into each radial compartment during a first mode of operation, and for discharging compressed fluid from said compressor chamber during a second mode of operation:

a second chamber associated with the valve plate assembly for discharging compressed fluid from said compressor chamber during a first mode of operation, and for admitting fluid to be compressed into said compressor chamber during a second mode of operation;

a valve disc associated with the valve plate assembly, the disc being disposed between the compressor chamber and the first and second chambers of the valve plate assembly, and including an aperture pair corresponding with each radial compartment, of which a first aperture is positioned to allow fluid communication between the corresponding radial compartment and the first chamber, and a second aperture is positioned to allow fluid communication between the corresponding radial compartment and the second chamber; and wherein each of said fixed solid segments includes a first and second internal wall dimensioned and aligned relative to said first and second apertures respectively such that said first and second chambers operate in said first mode of operation during rotation of the baffles towards the solid segment first wall and first apertures, and in said second mode of operation during rotation of the baffles in an opposite direction towards the solid segment second walls and second apertures.

2. A compressor unit for the production of compressible fluid, said unit including:

a compression portion including a compression chamber having a plurality of radial compartments defined by baffles;

a drive portion supporting a rotatably driveable shaft in operable communication with the compression portion;

a cam means for translating rotation motion of the rotatably driveable shaft into a back and forth oscillation movement of a shaft from which said baffles extend radially outwardly;

an inlet chamber adapted to admit fluid to be compressed into said compression chamber;

an outlet chamber adapted to discharge compressed fluid from said compression chamber;

fixed solid segments radially disposed inside said compression chamber such that each radial compartment includes a solid segment therein, each solid segment having walls extending towards the centre of the chamber and dimensioned such that during individual cycles fluid is drawn into one side of the compartment when a baffle moves away from said solid segment and fluid is compressed and discharged from the other side of the compartment when an adjacent baffle moves towards said solid segment;

a valve including a first chamber in fluid communication with one side of said radial compartment, and a second chamber in fluid communication the other side of said radial compartment, whereby fluid inside said first and second chambers is fluid that is either drawn into the compartment from the inlet means or is compressed fluid discharged out of the compartment by force of the baffles;

wherein said first and second chambers are in fluid communication with said inlet and outlet chambers such that in any one cycle the chamber, which is receiving compressed fluid is in fluid communication with the outlet chamber and the chamber from which fluid is being drawn is in fluid communication with the inlet chamber; and wherein said valve comprises a valve plate wherein said first and second chambers are in the form of inner and outer concentric rings, and a valve disc positioned between the valve plate and baffles, said valve disc comprising apertures adapted to allow for fluid communication between the radial compartments and the concentric rings.

3. The compressor unit of claim 2, wherein said inlet chamber comprises an open ended conduit, circumferentially positioned about one side of the outer concentric ring, wherein the respective ends of said open ended conduit connect by a separate hollow channel to one of the concentric rings.

4. The compressor unit of claim 3, wherein said outlet chamber comprises an open ended conduit, extending about the outer concentric ring on an opposing side to said inlet open ended conduit, wherein the respective open ends of said conduit connect by a separate hollow channel of one of the concentric rings.

5. The compressor unit of claim 4, wherein said valve means includes a rocker control valve in oscillating operable communication with the cam means so that just a single end to each of the open ended conduits of the respective inlet and outlet means are open during a particular cycle or back/fourth oscillation.

6. The compressor unit of claim 3, wherein said baffle shaft includes six radially disposed baffles defining six radial compartments.

7. A compressor unit for the production of compressible fluid, said unit comprising:

a main housing block, said main housing block providing a drive portion supporting a rotatably drivable shaft in operable communication with a compression portion of said main housing block;

the compression portion defining a compressor chamber in its interior;

an inlet, communicating with said rotatably drivable shaft and the compressor chamber of the main housing block, for admitting fluid to be compressed into said compressor chamber of the compression portion of the main housing block;

an outlet communicating with said compression chamber for discharging compressed fluid from said compression chamber of the compressor portion of the main housing block to a compressed fluid storage tank;

two substantially circular rings or slots supported within a single plate or platform wherein said substantially circular rings are concentric one about the other, said circular rings defining hollow passage ways through the plate or platform; along the lengths of these hollow passages are a series of apertures adapted to allow fluid to enter the concentric rings, pass through the hollow passages and out through the apertures to either enter or exit said compression chamber;

said inlet comprising a first open ended conduit, circumferentially positioned about one side of the outer substantially concentric rings, wherein the respective ends of said open ended conduit connect by a separate hollow channel to one of the concentric rings;

said outlet comprising a second open ended conduit, extending about the outer concentric ring contained in the single plate or platform on an opposing side to said first open ended conduit wherein the respective open ends of said second conduit connect with a separate hollow channel of one of the concentric rings;

flow control valves adapted to control the admitted and discharged fluid/compressed fluid to and from the hollow passages of the concentric circular rings; the compressor chamber liirther defining a compressing area adapted to compress admitted fluid, rotably supporting crisscrossing baffles and intermittent triangular segments adapted to move relative to each other; each said triangular segment including, orifices or elongated recesses at least partially extending into the depth of said triangular segment, wherein each orifice or recess is located on an opposing side edge triangular segment so as to enable simultaneous intake and discharge of fluid to a corresponding concentric ring; and a cam mechanism adapted to translate the rotable motion of the rotatably drivable shaft into a back and forth oscillation movement of said crisscrossing baffles against the triangular section for fluid to be admitted through the recess or orifice or to be discharged from the opposing orifice or recess during oscillation individual cycles.

8. The compressor unit and/or pump arrangement of claim 7, wherein the flow control valves are in oscillating operable communication with the earn mechanism so that a single end to each of the open ended conduits of the respective inlet and outlet are open during a particular cycle or back and fourth oscillation movement.

9. The compressor unit and/or pump arrangement of claim 7, wherein the baffles are supported on a rotatable shaft, wherein the rotatable shaft is arranged with respect to the cam mechanism so as to oscillate or swing back and forth over a defined degree of angle.

10. The compressor unit and/or pump arrangement of claim 9, wherein said angle of oscillation is about twenty degrees.

11. The compressor unit and/or pump arrangement of claim 7, wherein the crisscrossing baffles comprise six individual radially extending baffles from the main rotable support shaft in the compression chamber establishing six divided partitions.

12. The compressor unit and/or pump arrangement of claim 11, wherein the triangular segments are fixed around the outer frame such that within each of said partitions is the corresponding triangular segment.

13. The compressor unit and/or pump arrangement of claim 7, wherein the inlet and outlet conduits would in fact also be slots or passageways circumferentially encompassing opposing sides within the plate or platform around the outermost concentric ring.

14. The compressor and/or pump arrangement of claim 7, 'wherein the orifices or elongated recesses are substantially conical or cone type in configuration with part of the edge, length or shoulder of the conical configuration opened up so as to provide a fluid passage flow moving from or to a space of varying bounded dimension.

15. The compressor or pump unit of claim 1, wherein said valve plate assembly further includes an inlet chamber and an outlet chamber and, by use of a control valve, fluid is allowed to pass from the inlet chamber into the first chamber and from the second chamber into the outlet chamber during said first mode of operation, and from the inlet chamber into the second chamber and from the first chamber into the outlet chamber during said second mode of operation.

16. The compressor or pump unit of claim 15, wherein said control valve is in the form of a rocker switch which is rotatably oscillated together with the central shaft and baffles between a first position which prevents flow of fluid from the first chamber to the outlet chamber and from the inlet chamber to the second chamber, and a second position which prevents flow of fluid from the inlet chamber into the first chamber and from the second chamber to the outlet chamber.

17. The compressor or pump unit of claim 15, wherein the valve plate assembly includes a circular valve plate wherein the first chamber and second chamber are formed in said plate as co-planar concentric rings, and said inlet chamber and outlet chamber are formed in said plate as two separated halves of a further co-planar and outermost concentric ring, wherein each half ring includes a connecting channel to each of the first and second chambers.

18. The compressor or pump unit of claim 17, wherein a first channel connects the first chamber to the outlet chamber, a second channel connects the first chamber to the inlet chamber, a third channel connects the second chamber to the outlet chamber, and a fourth channel connects the second chamber to the inlet chamber, wherein each channel is not coplanar with said concentric rings such that fluid passes between the chambers and channels via apertures in said valve plate.

19. The compressor or pump unit of claim 18, wherein said control valve is in the form of a rocker arm which is associated with said valve plate, said rocker arm configured to be rotatably oscillated together with the central shaft and baffles between a first position in which the rocker switch covers said valve plate apertures into said first and fourth channels and a second position in which the rocker switch covers said valve plate apertures into said second and third channels.

20. The compressor or pump unit of claim 1, further including a drive portion supporting a rotatably driveable shaft in operable communication with the central shaft.

21. The compressor or pump unit of claim 20, wherein said drive portion includes an electric motor for rotating said driveable shaft.

22. The compressor or pump unit as of claim 20, wherein means of oscillating the baffles is in the form of a cam mechanism adapted to translate the rotational motion of the driveable shaft into a back and forth rotation oscillation movement of the central shaft.

23. The compressor or pump unit of claim 1, wherein said apparatus includes six radially disposed baffles defining six radial compartments within which there is disposed six solid segments.

24. The compressor or pump unit of claim 1, wherein an angle of oscillation of said central shalt is twenty degrees.

25. The compressor or pump unit of claim 1, wherein each internal wall of each solid segment includes a recess extending into the depth of the solid segment from the valve plate assembly end of the compression chamber wherein each recess is substantially aligned with said first and second aperture of said disc.

26. The compressor or pump unit of claim 25, wherein each recess is substantially conical in shape.

* * * * *